US011953298B2

(12) United States Patent
Hagberg et al.

(10) Patent No.: US 11,953,298 B2
(45) Date of Patent: Apr. 9, 2024

(54) BRAKE ARRANGEMENT FOR A PROJECTILE

(71) Applicant: BAE SYSTEMS BOFORS AB, Karlskoga (SE)

(72) Inventors: Anders Hagberg, Karlskoga (SE); Thomas Pettersson, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 78 days.

(21) Appl. No.: 17/781,799

(22) PCT Filed: Dec. 1, 2020

(86) PCT No.: PCT/SE2020/051152

§ 371 (c)(1),
(2) Date: Jun. 2, 2022

(87) PCT Pub. No.: WO2021/126040

PCT Pub. Date: Jun. 24, 2021

(65) Prior Publication Data

US 2023/0003494 A1 Jan. 5, 2023

(30) Foreign Application Priority Data

Dec. 20, 2019 (SE) ..... 1900214-6

(51) Int. Cl.
*F42B 10/50* (2006.01)

(52) U.S. Cl.
CPC ..... *F42B 10/50* (2013.01)

(58) Field of Classification Search
CPC ..... F42B 10/50
See application file for complete search history.

(56) References Cited

U.S. PATENT DOCUMENTS

| | | | | |
|---|---|---|---|---|
| 1,294,604 A | | 2/1919 | Berentsen | |
| 3,047,259 A | * | 7/1962 | Tatnall | F42B 10/50 244/158.9 |
| 3,179,052 A | | 4/1965 | Raymond | |
| 5,237,925 A | * | 8/1993 | Vogt | F42B 10/50 102/386 |
| 5,826,821 A | | 10/1998 | Brandon et al. | |
| 2005/0258308 A1 | * | 11/2005 | Bar | F42B 10/50 244/113 |

FOREIGN PATENT DOCUMENTS

| | | | |
|---|---|---|---|
| DE | 4124659 | A1 | 2/1993 |
| KR | 20100088490 | A | 8/2010 |
| KR | 20130104362 | A | 9/2013 |
| WO | 9801719 | A1 | 1/1998 |

OTHER PUBLICATIONS

International Search Report (dated Jan. 18, 2021) for corresponding International App. PCT/SE2020/051152.

* cited by examiner

*Primary Examiner* — J. Woodrow Eldred
(74) *Attorney, Agent, or Firm* — WRB-IP PLLC

(57) ABSTRACT

In a brake for detachable arrangement on projectiles, the brake is configured with a surface which is situated in the direction of travel of the projectile, where the surface is larger than a surface given by $\pi R^2 - \pi r^2$, where R is the outer radius of the brake and r is the inner radius of the brake. A method for braking projectiles is also provided.

10 Claims, 5 Drawing Sheets

BRAKE ARRANGEMENT FOR A PROJECTILE

BACKGROUND AND SUMMARY

The present invention relates to an improved brake for removable arrangement on projectiles.

A conventional barrel weapon, or firing device, means here a weapon of the type of an artillery piece, a naval piece, or a tank piece or other piece containing a barrel in which a projectile is fired and propelled through the barrel by a propellant charge with is ignited by means of an igniter, such as a spark plug, an ignition cartridge, etc. The propellant charge, also called the propellant, refers here to a powder of solid form, which gives off gases during its burning, driving the projectile forward to the mouth of the barrel under high pressure in the barrel. The propellant can also be a type other than a solid powder.

If short firing range is desired, the propellant can be adapted to a certain extent to generate a suitable firing range for the specific projectile. However, there are limits, so that the propellant cannot be reduced to such a degree that fundamental technical requirements cannot be achieved. For example, a certain propellant is required in order to propel the projectile out from the barrel, and there may also be demands on the minimum charge size of the firing device, etc.

In the firing scenario when short trajectory is required, the projectile may be provided with a braking arrangement in order to effectively brake the projectile on its trajectory. Examples of braking arrangements may be various devices which deploy mechanically or otherwise from the projectile, but there may also be a brake firmly arranged on the projectile prior to its firing.

Mechanically deployable brakes are described, for example, in patent document WO 98/01719 A. The brake here consists of four different braking plates, which are unfolded or pushed out radially from the projectile and which form a planar braking surface, encircling the projectile in part. The solution is mechanically complex and requires space in the detonator.

An example of a braking device which is arranged on the projectile before its firing is shown in FIG. 1. The braking arrangement is a washer which is arranged between the detonator of the projectile and the projectile body prior to its firing. The washer preferably has a planar braking surface which is situated in the direction of travel of the projectile and has a braking effect during the travel of the projectile to its target. The washer shown has a limited braking ability.

It is desirable to solve the above-identified problem.

Thus, according to an aspect of the present invention an improved brake for detachable arrangement on projectiles is created, where the brake is configured with a braking surface which is situated in the direction of travel of the projectile, where the braking surface is larger than a surface given by $\pi R^2 - \pi r^2$, where R is the outer radius of the brake and r is the inner radius of the brake.

According to further aspects of the improved brake of the invention:

- the brake is configured as a truncated cone with an inner radius, an outer radius and a side;
- the brake is configured as a truncated cone with bottom having a height at the bottom between 10 mm and 60 mm;
- the brake is configured as a truncated oblate ellipsoid of revolution defined by inner radius, an outer radius, and a side;

- the brake is configured as a truncated oblate ellipsoid of revolution with bottom having a height at the bottom between 10 mm and 60 mm;
- the side has a length between 10 mm and 75 mm;
- the brake is configured as a washer arranged with an edge having an inner radius, an outer radius and an edge length;
- the brake is arranged with a middle segment such that the brake is arranged with one part of the brake situated in front of the middle segment, having a length, and one part of the brake situated behind the middle segment, having a length;
- the braking surface of the brake is arranged with at least one through hole on the braking surface, where the braking surface is the surface between the inner radius and the outer radius.

Moreover, according to an aspect of the present invention an improved method for braking projectiles is created, involving the arrangement of a brake between a detonator and a shell body, where the brake is configured with a braking surface which is situated in the direction of travel of the projectile, where the surface is larger than a surface given by $\pi R^2 - \pi r^2$, where R is the outer radius of the brake and r is the inner radius of the brake.

BRIEF DESCRIPTION OF THE DRAWINGS

The invention shall be described more closely below, making reference to the enclosed figures, where.

DETAILED DESCRIPTION

In order to increase the air resistance when projectiles such as artillery shells are fired with a firing device, such as an artillery piece, a brake washer can be arranged on the projectile.

Preferably, the brake washer is situated between the detonator and the shell. The shell is also called the shell body or projectile body. The detonator can also be called the zone tube or timing tube, and is called the fuse in English. The detonator is arranged removably on the shell in a customary embodiment of artillery shells. A brake washer may then be arranged between the detonator and the shell. The detonator is preferably stored and transported separately from the shell and it is arranged and primed on the shell when the projectile is to be fired from the firing device.

Brake washers are used when a short firing range is desired, for example when firing with high elevation. One alternative for achieving short firing range is to use a smaller amount of propellant, or a propellant which produces less gas release, but a minimum amount of propellant is needed in order to fire the projectile from the firing device in a secure manner.

Figure 1:
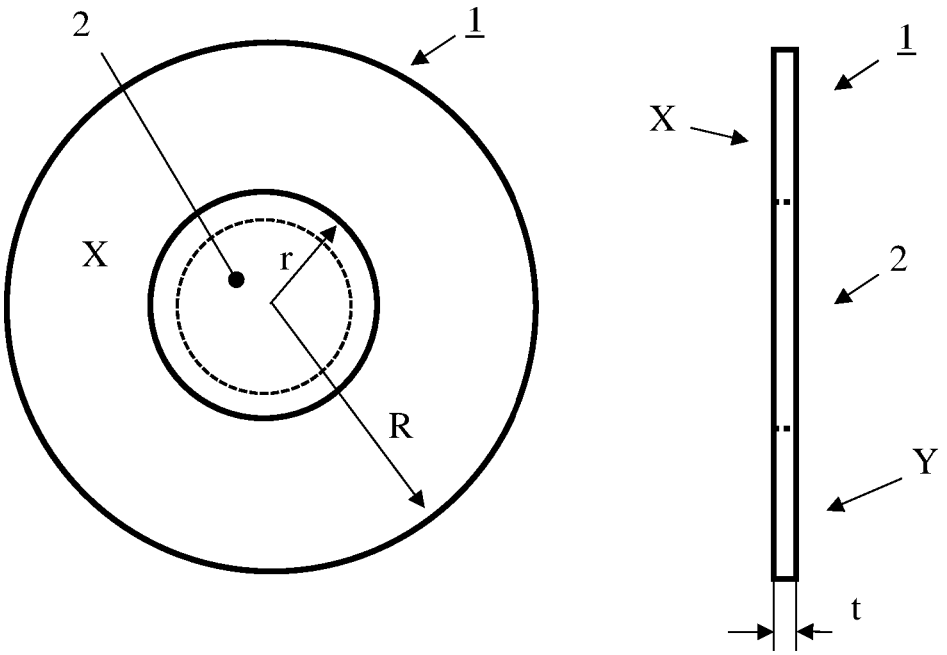
FIG. 1 shows schematically a brake washer, in a front view and a cross sectional view from the side, according to the prior art.

FIG. 1 shows a conventional brake washer 1, preferably formed of homogeneous metal, such as steel, which may be surface treated, for example to be stainless during storage. The brake washer 1 has a front side, with a surface X, and a rear side, with a surface Y, the front side with surface X being planar. The planar front side with surface X is situated perpendicular to an imaginary center line for a projectile where the brake washer 1 is arranged on a projectile 100. See FIG. 9 for an illustration of a projectile arranged with a brake washer 1. The brake washer 1 is arranged with a central hole 2 which is designed to pass over the thread arranged on the detonator. Preferably, the shell is devised with a female thread and the detonator with a male thread, so that parts of the detonator pass through the brake washer 1. Thus, the brake washer 1 is preferably arranged on the detonator 101 before the detonator 101 is arranged on the shell 102. In one embodiment, a projectile 100 consists of or comprises a detonator 101 arranged on a shell 102. The central hole 2 has a radius designed to pass over the detonator. One portion of the brake washer will be situated between the outer radius of the projectile and the thread situated on the detonator. The portion of the brake washer which is situated outside the outer radius of the projectile constitutes the active braking surface. The inner portion of the braking surface X has a radius τ, and the outer radius of the washer, and thus the outer radius of the braking surface, is denoted as R. The surface X, or the braking surface, is computed by the formula:

$$X=\pi R^2-\pi^2 \quad (1)$$

Thus, the total surface of the brake washer is composed of the braking surface X and the surface situated between the outer radius of the projectile, r, and the radius of the hole 2.

Figure 2:
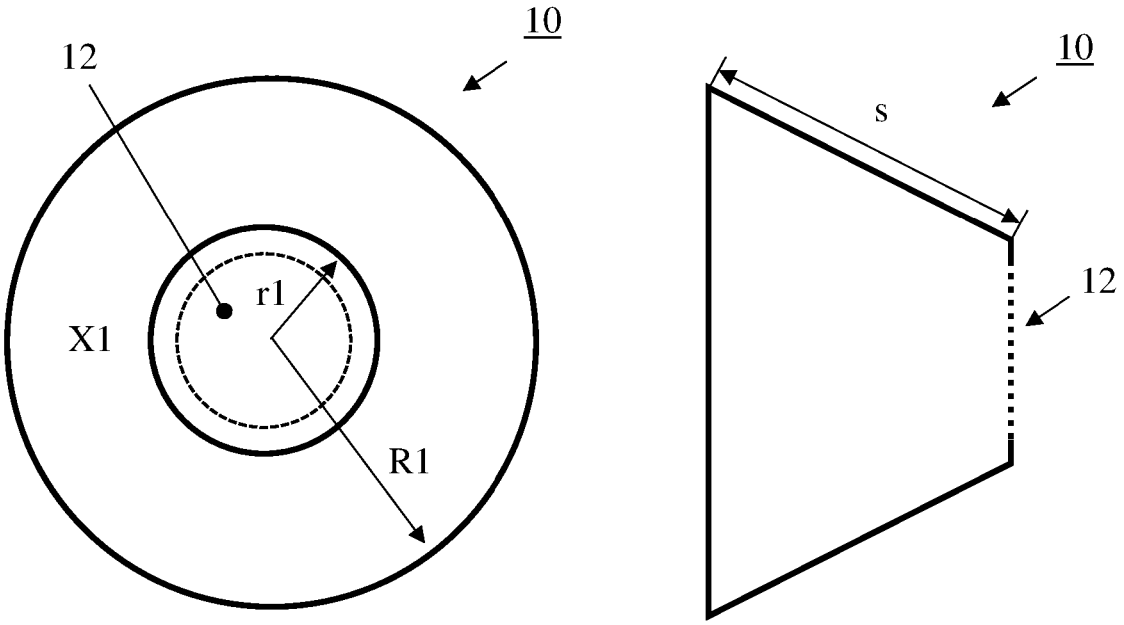
FIG. 2 shows a brake, in a front view and a side view, according to a first embodiment of the invention.

FIG. 2 shows a brake configured as a truncated cone 10 according to a first embodiment of the invention. The truncated cone 10 is defined by an inner radius, r1, an outer radius R1, and a side s. The thickness is preferably the same in the entire configuration of the truncated cone. The inner surface of the truncated cone is denoted as X1. The surface X1 is larger than the theoretical surface X, which is defined as:

$$\pi R1^2-\pi r1^2 \quad (2).$$

A brake with a configuration as a truncated cone provides a better braking ability as compared to a brake with conventional configuration as a brake washer, because the surface X1 is larger than the theoretical surface X. The truncated cone can be fabricated by conventional lathe turning, but also by pressure turning, pressing, or drawing. Moreover, the truncated cone can be manufactured by powder technology or additive manufacturing. Besides steel, the truncated cone can be made of other metals, such as aluminum, various forms of composites or plastics, ceramics, or various forms of powder, such as metal powder. The total surface of the brake is thus constituted of the braking surface X1 and the surface which is situated between the outer radius of the projectile, r1, and the radius of the hole 12.

Figure 3:
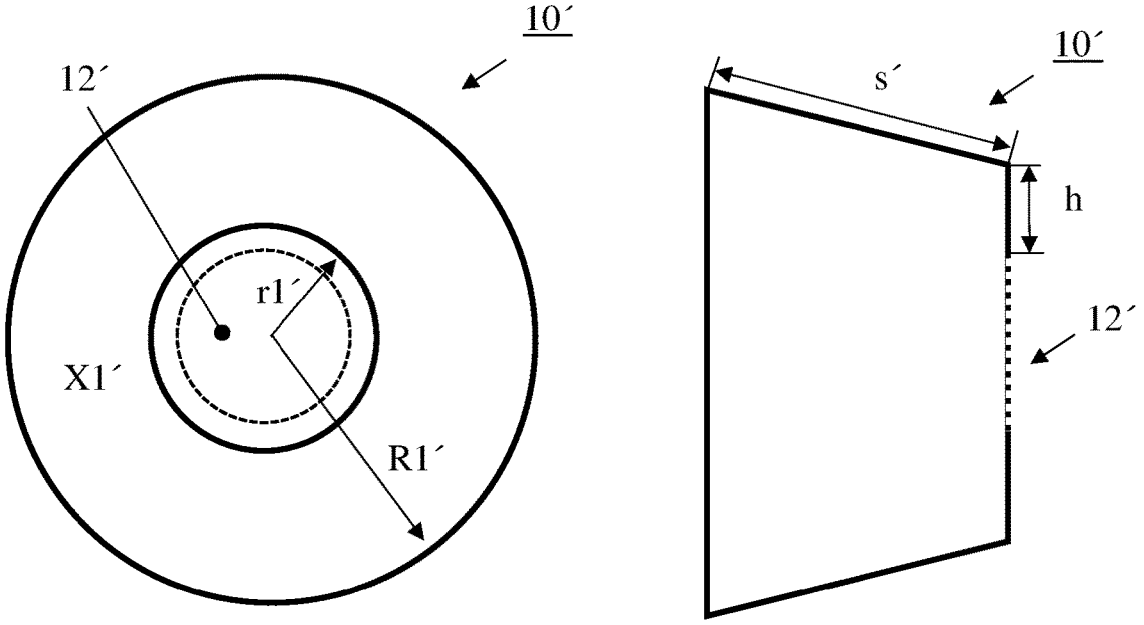
FIG. 3 shows a brake, in a front view and a side view, according to a second embodiment of the invention.

FIG. 3 shows a brake configured as a truncated cone having a bottom 10' according to a second embodiment of the invention. The truncated cone with bottom 10' is defined by an inner radius r1', an outer radius R1', a height at the bottom h and a side s'. The thickness is preferably the same in the entire configuration of the truncated cone with bottom. The inner surface of the truncated cone with bottom is denoted as X1'. The surface X1' is larger than the theoretical surface X, which is defined as:

$$\pi R1'^2-\pi r1'^2 \quad (3).$$

A brake with a configuration as a truncated cone with bottom provides a better braking ability as compared to a brake with conventional configuration as a brake washer, because the surface X1' is larger than the theoretical surface X. The truncated cone with bottom can be fabricated by conventional lathe turning, but also by pressure turning, pressing, or drawing. Moreover, the truncated cone with bottom can be manufactured by powder technology or additive manufacturing. Besides steel, the truncated cone with bottom can be made of other metals, such as aluminum, various forms of composites or plastics, ceramics, or various forms of powder, such as metal powder. The total surface of the brake is composed of the braking surface X1' and the surface situated between the outer radius of the projectile, r1' and the radius of the hole 12'.

Figure 4:
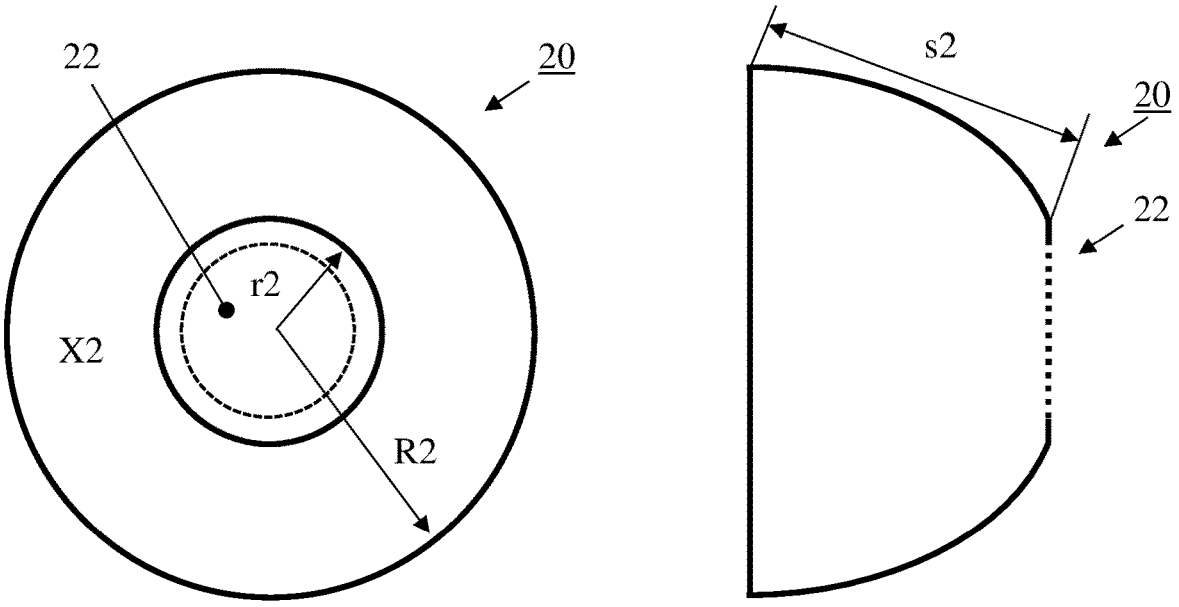
FIG. 4 shows a brake, in a front view and a side view, according to a third embodiment of the invention.

FIG. 4 shows a brake configured as a truncated oblate ellipsoid of revolution 20 according to a third embodiment of the invention. The truncated oblate ellipsoid of revolution is defined by an inner radius r2, an outer radius R2, and a side s2. The side s2 consists of or comprises a curved transition between the inner radius r2 and the outer radius R2, preferably shaped as an oblate ellipsoid of revolution. The inner surface of the truncated oblate ellipsoid of revolution is denoted as X2. The surface X2 is larger than the theoretical surface X which is defined as:

$$\pi R2^2-\pi r2^2 \quad (4).$$

A brake with a configuration as a truncated oblate ellipsoid of revolution provides a better braking ability as compared to a brake with conventional configuration as a brake washer, because the surface X2 is larger than the theoretical surface X. The truncated oblate ellipsoid of revolution can be fabricated by conventional lathe turning, but also by pressure turning, pressing, or drawing. Moreover, the truncated oblate ellipsoid of revolution can be manufactured by powder technology or additive manufacturing. Besides steel, the truncated oblate ellipsoid of revolution can be made of other metals, such as aluminum, various forms of composites or plastics, ceramics, or various forms of powder, such as metal powder. The total surface of the brake is composed of the braking surface X2 and the surface situated between the outer radius of the projectile r2 and the radius of the hole 22.

Figure 5:
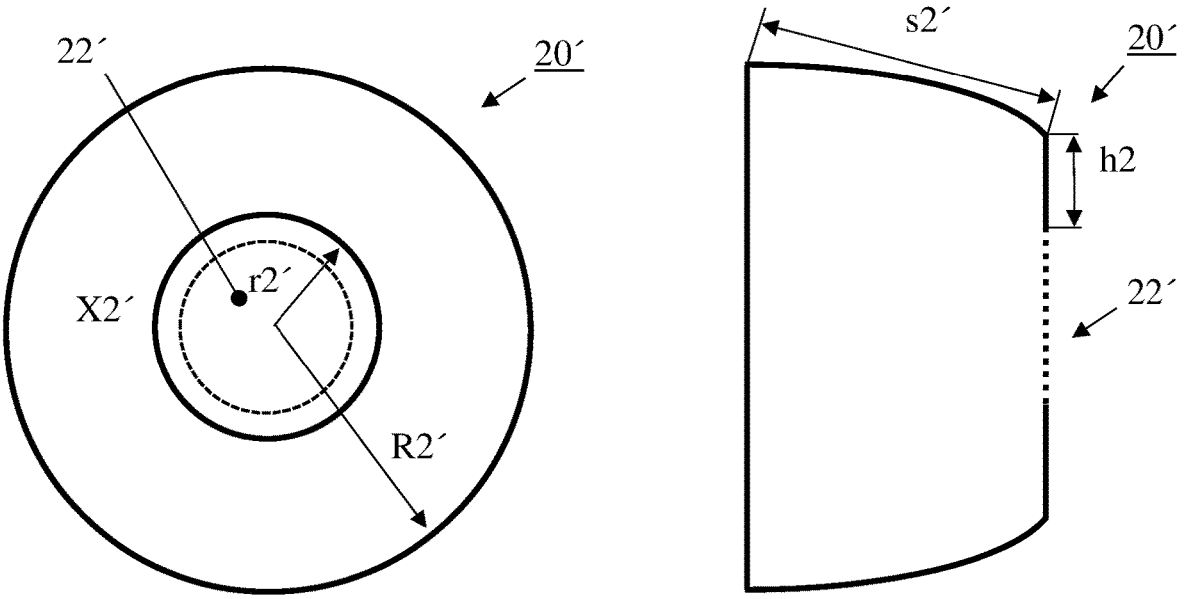
FIG. 5 shows a brake, in a front view and a side view, according to a fourth embodiment of the invention.

FIG. 5 shows a brake configured as a truncated oblate ellipsoid of revolution with bottom 20' according to a fourth embodiment of the invention. The truncated oblate ellipsoid of revolution with bottom is defined by an inner radius r2', an outer radius R2', and a side s2'. The inner surface of the truncated oblate ellipsoid of revolution is denoted as X2'. The surface X2' is lamer than the theoretical surface X, defined as:

$$\pi R2'^2-\pi r2'^2 \quad (5).$$

A brake with a configuration as a truncated oblate ellipsoid of revolution with bottom provides a better braking ability as compared to a brake with conventional configuration as a brake washer, because the surface X2' is larger than the theoretical surface X. The truncated oblate ellipsoid of revolution with bottom can be fabricated by conventional lathe turning, but also by pressure turning, pressing, or drawing. Moreover, the truncated oblate ellipsoid of revolution with bottom can be manufactured by powder technology or additive manufacturing. Besides steel, the truncated oblate ellipsoid of revolution with bottom can be made of other metals, such as aluminum, various forms of composites or plastics, ceramics, or various forms of powder, such as metal powder. The total surface of the brake is composed of the braking surface X2' and the surface situated between the outer radius of the projectile r2' and the radius of the hole 22'.

Figure 6:
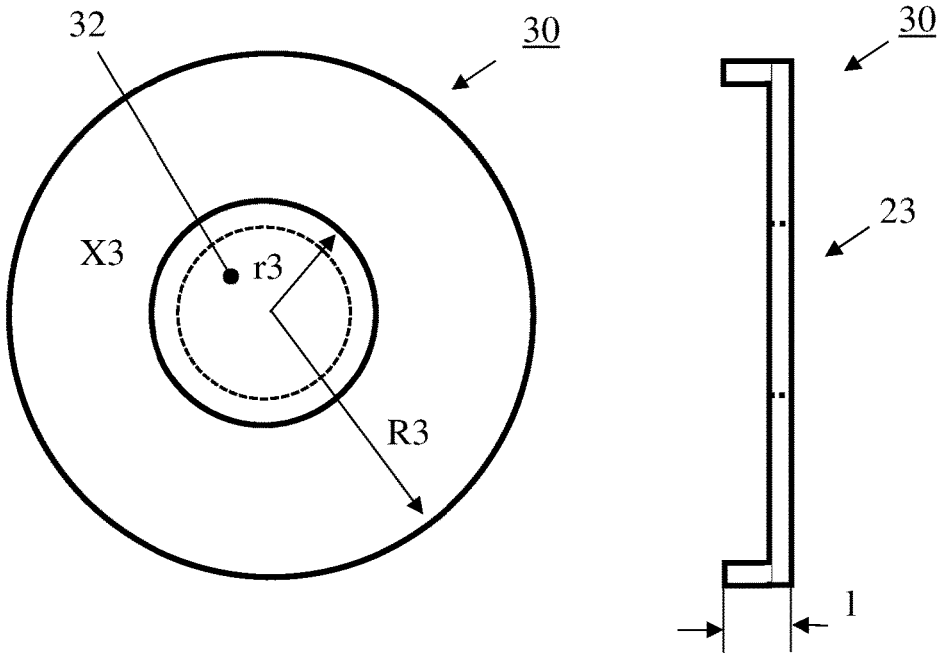
FIG. 6 shows a brake, in a front view and a cross sectional view from the side, according to a fifth embodiment of the invention.

FIG. 6 shows a brake configured as a brake washer with an edge 30 according to a fifth embodiment of the invention. The brake washer with an edge is defined by an inner radius r3, an outer radius R3, and a length l. The inner surface of the brake washer with an edge is denoted as X3. The surface X3 is larger than the theoretical surface X, defined as:

$$\pi R3^2-\pi r3^2 \quad (6).$$

A brake with a configuration as a brake washer with an edge provides a better braking ability as compared to a brake with conventional configuration as a brake washer, because the surface X3 is larger than the theoretical surface X The total surface of the brake is thus composed of the braking surface X3 and the surface situated between the outer radius of the projectile r3 and the radius of the hole 32. The brake washer with an edge can be fabricated by conventional lathe turning, but also by pressure turning, pressing, or drawing. Moreover, a brake washer with an edge can be manufactured by powder technology or additive manufacturing. Besides steel, a brake washer with an edge can be made of other metals, such as aluminum, various forms of composites or plastics, ceramics, or various forms of powder, such as metal powder.

Figure 7:
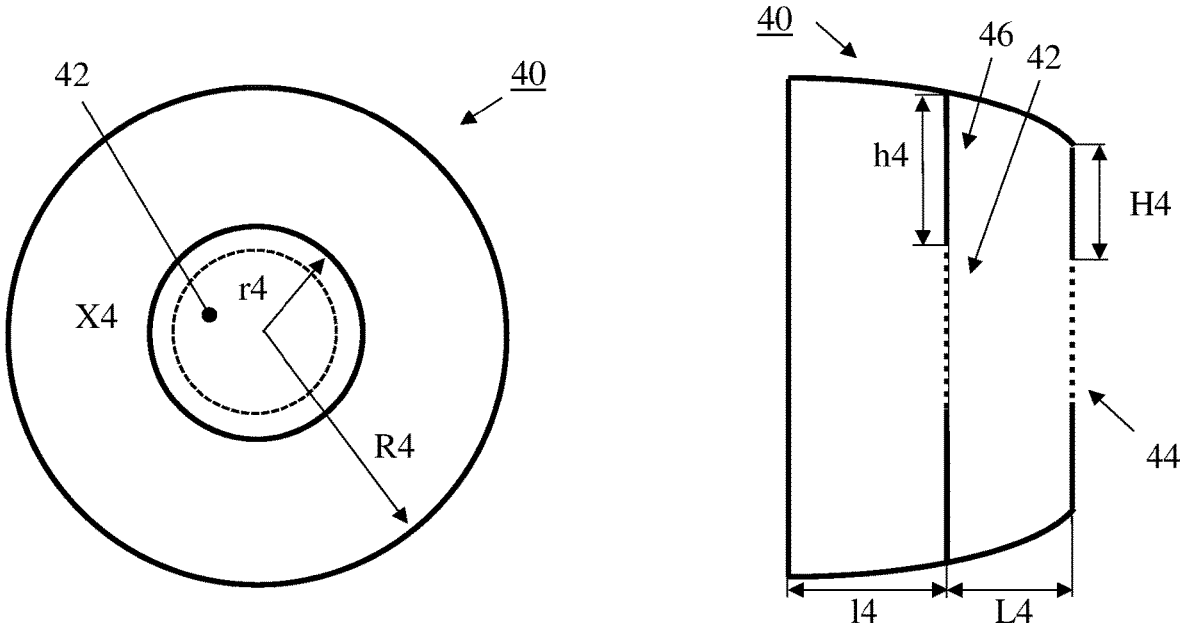
FIG. 7 shows a brake, in a front view and a side view, according to a sixth embodiment of the invention.

FIG. 7 shows a brake configured with a middle segment 40 according to a fifth embodiment of the invention. The brake washer with middle segment 40 is defined by an inner radius r4, an outer radius R4, and one portion of the brake is arranged in front of the middle segment 46 with length l4, and one portion is arranged behind the middle segment 46 with length L4. The middle segment 46 is designed with a height h4, from the hole 42. Moreover, a brake configured with a middle segment 40 is closed off against the shell, in the portion which is situated behind the middle segment 46, by a bottom plate having a height H4 from the hole 44. The inner surface of the brake washer with a middle segment is denoted as X4. The surface X4 is lamer than the theoretical surface X, defined as $$\pi R^4 2-\pi r4^2 \quad (6).$$

A brake with a configuration as a brake washer with middle segment 40 provides a better braking ability as compared to a brake with conventional configuration as a brake washer, because the surface X4 is larger than the theoretical surface X The total surface of the brake is thus composed of the braking surface X4 and the surface situated between the outer radius of the projectile r4 and the radius of the hole 42. The portion of the brake configured with a middle segment 40 situated behind the middle segment 46 is designed with a hole 44 through which the shell body 102 can pass. The brake washer with middle segment can be fabricated by conventional lathe turning, but also by pressure turning, pressing, or drawing. Moreover, a brake washer with middle segment can be manufactured by powder technology or additive manufacturing. Besides steel, a brake washer with middle segment can be made of other metals, such as aluminum, various forms of composites or plastics, ceramics, or various forms of powder, such as metal powder.

Figure 8:
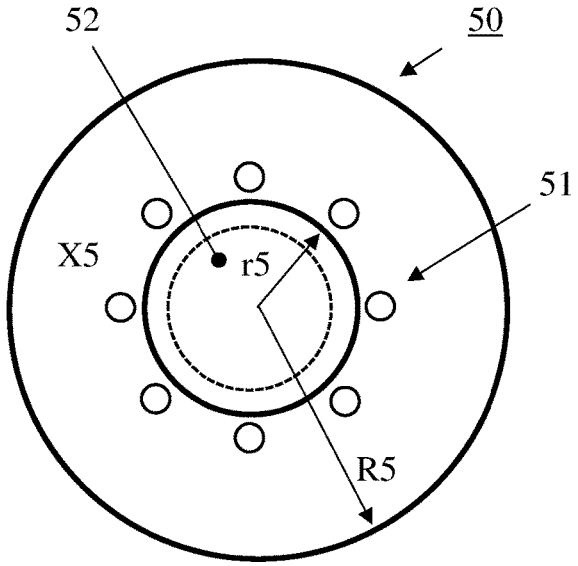
FIG. 8 shows a brake, in a front view, according to a seventh embodiment of the invention.

FIG. 8 was a brake configured with a hole 50 according to a sixth embodiment of the invention. The braking surface is designed with at least one hole 51. The total surface of the brake is thus composed of the braking surface X5 which is the surface between the outer radius R5 and the inner radius r5, and the surface situated between the outer radius of the projectile r5 and the radius of the hole 52, minus the total surface of the hole 51 situated on the braking surface X5.

Figure 9:
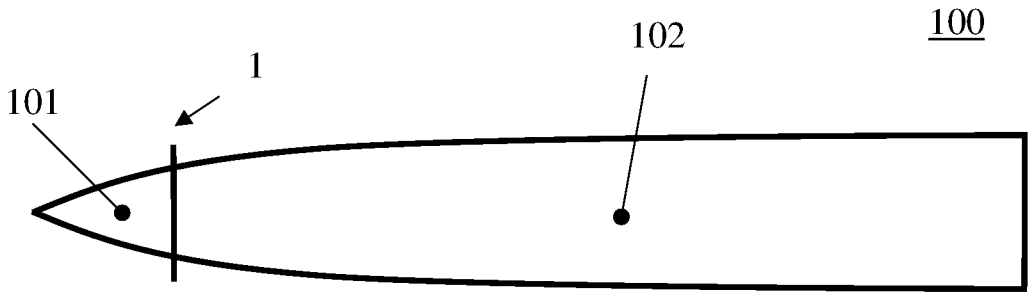
FIG. 9 shows a projectile arranged with a brake washer according to the prior art.

FIG. 9 shows a projectile 100 containing a detonator 101, a shell body 102, and a brake washer 1. The detonator 101, in one customary configuration, is produced with threads so that the detonator can be screwed onto the shell body 102. A brake washer 1 is arranged between the detonator 101 and the shell body 102 when the detonator 101 is being arranged on the shell body 102. The detonator 101 is arranged on the shell body 102 before the projectile is fired from the firing device; this event may also be called the priming. In concert with the priming, when the detonator is arranged on the shell body, the detonator can be programmed or otherwise adapted to the current firing mission and be arranged with a brake or brake washer.

The function and application of the brake is that the brake is arranged on the projectile before firing the projectile in connection with the projectile being primed, usually by arranging the brake on the detonator and screwing the detonator, with brake, onto the shell. When the projectile leaves the gun barrel, the brake will produce great air resistance (drag), which lessens the firing range of the projectile. The air resistance with the new brakes shown in the invention is increased as compared to relatively known brake washers in that the surface of the brake is increased, and by the brake configurations shown in the invention.

One example of a brake is a conically shaped structure with an inner radius, r1, r1', r2, r2', r3, r4, r5, of 50 mm at the inner hole, an outer radius, R1, R1', R2, R2', R3, R4, R5, of 100 mm, a length 1, s, s', s2, s2' of 40 mm, a thickness of 5 mm, and made of steel.

The invention is not limited to the configurations shown especially, but instead can be varied in different ways within the patent claims.

It is evident, for example, that the number, size, material and shape of the elements and parts making up the brake can be adapted according to the weapons system or systems and other design properties in the particular instance.

It is evident that the above-described brakes for projectiles may comprise many different dimensions and projectile types, depending on the area of application and the barrel width. However, at least the most commonly occurring projectiles today, between around 20 mm and 200 mm, are considered above.

The invention claimed is:

1. A projectile with a brake, comprising a projectile, the projectile having a detonator and a shell body, and a brake detachably arranged between part of the detonator and part of the shell body, wherein the brake is configured with a brake surface which is situated in a direction of travel of the projectile, where the brake surface is larger than a surface given by $\pi R^2$-$\pi r^2$, where R is an outer radius of the brake and r is an inner radius of the brake.

2. The projectile with the brake according to claim 1, wherein the brake is configured as a truncated cone with the inner radius, the outer radius and a side.

3. The projectile with the brake according to claim 2, wherein the brake is configured as a truncated cone with a bottom, the truncated cone having a diameter at the bottom between 10 mm and 60 mm.

4. The projectile with the brake according to claim 1, wherein the brake is configured as a truncated oblate ellipsoid of revolution defined by the inner radius, the outer radius, and a side.

5. The projectile with the brake according to claim 4, wherein the brake is configured as a truncated oblate ellipsoid of revolution with a bottom, the truncated oblate ellipspoid having a diameter at the bottom between 10 mm and 60 mm.

6. The projectile with the brake according to claim 2, wherein the side has a length between 10 mm and 75 mm.

7. The projectile with the brake according to claim 1, wherein the brake has an edge with an edge length.

8. The projectile with the brake according to claim 1, wherein the brake is arranged with a middle segment such that the brake is arranged with one part of the brake situated in front of the middle segment, the one part of the brake situated in front of the middle segment having a first length, and one part of the brake situated behind the middle segment, the one part of the brake situated behind the middle segment having a second length.

9. The projectile with the brake according to claim 1, wherein the brake surface of the brake is arranged with at least one through hole on the brake surface, where the brake surface is a surface between the inner radius and the outer radius.

10. A method for braking projectiles, comprising launching a projectile, the projectile having a detonator and a shell body, and braking the projectile with a brake detachably arranged between part of a detonator and part of a shell body, wherein the brake is configured with a surface which is situated in a direction of travel of the projectile, where the surface is larger than a surface given by $\pi R^2$-$\pi r^2$, where R is an outer radius of the brake and r is an inner radius of the brake.

* * * * *